US005430458A

United States Patent [19]

Weber

[11] Patent Number: 5,430,458

[45] Date of Patent: Jul. 4, 1995

[54] SYSTEM AND METHOD FOR ELIMINATING FLICKER IN DISPLAYS ADDRESSED AT LOW FRAME RATES

[75] Inventor: Larry F. Weber, New Paltz, N.Y.

[73] Assignee: Plasmaco, Inc., Highland, N.Y.

[21] Appl. No.: 756,177

[22] Filed: Sep. 6, 1991

[51] Int. Cl.[6] ..... G09F 9/313

[52] U.S. Cl. ..... 345/60; 345/67; 345/68

[58] Field of Search ..... 340/766, 771, 776, 781–788; 315/169.4; 345/11, 60, 61, 133, 62, 134, 67, 68, 99, 208, 67, 68; 348/797

[56] References Cited

U.S. PATENT DOCUMENTS

| | | | |
|---|---|---|---|
| 3,559,190 | 1/1971 | Bitzer et al. | 348/797 |
| 4,743,896 | 5/1988 | Hashimoto et al. | 340/765 |
| 4,772,884 | 9/1988 | Weber et al. | 340/776 |
| 4,859,910 | 8/1989 | Iwakawa et al. | 340/771 |
| 4,866,349 | 9/1989 | Weber et al. | 340/776 |
| 5,030,888 | 7/1991 | Salavin et al. | 340/771 |
| 5,086,257 | 2/1992 | Gay et al. | 340/776 |
| 5,107,182 | 4/1992 | Sano et al. | 315/169.4 |
| 5,134,389 | 7/1992 | Furuta et al. | 340/708 |
| 5,136,282 | 8/1992 | Inaba et al. | 340/784 |
| 5,202,674 | 4/1993 | Takemori et al. | 345/208 |

*Primary Examiner*—Tommy P. Chin
*Assistant Examiner*—Gin Goon
*Attorney, Agent, or Firm*—Perman & Green

[57] ABSTRACT

A method and system are described for reducing flicker in a display panel. The method comprises the steps of sequentially addressing rows of pixels in the panel, each addressed row location made active by applied address signals during a row address period. Addressed locations along an active row emit light when addressed. During a row address period, simultaneous addresses are applied to a plurality of additional dummy rows in the panel. The addressing is accomplished with signals that do not change memory display states at locations along the additional dummy rows, but do cause locations along the additional dummy rows to emit light during each row address period.

33 Claims, 8 Drawing Sheets

STEP 1

STEP 2

SYSTEM AND METHOD FOR ELIMINATING FLICKER IN DISPLAYS ADDRESSED AT LOW FRAME RATES

FIELD OF THE INVENTION

This invention relates to flat screen display panels, and more particularly to a system and method for eliminating background flicker in such panels.

BACKGROUND OF THE INVENTION

A.C. Plasma display panels are known in the art and, in general, comprise a pair of transparent substrates respectively supporting column and row electrodes, each coated with a dielectric layer and disposed in parallel spaced relation to define a gap in which an ionizable gas is sealed. The substrates are arranged such that the electrodes are disposed in orthogonal relation to one another, thereby defining points of intersection which, in turn, define discharge cells at which selective discharges may be established to provide a desired storage or display function. Such panels are operated with AC voltages and provide a write voltage which exceeds the firing voltage of the ionizable gas at a point on the panel, as defined by selected column and row electrodes, thereby producing a discharge at a selected cell. The discharge at the selected cell is continuously "sustained" by applying an alternating sustain voltage (which, by itself is insufficient to initiate a discharge). This technique relies upon the wall charges that are generated on the dielectric layers of the substrates which, in conjunction with the sustain voltage, operate to maintain discharges.

Details of the structure and operation of such gas discharge panels or plasma displays are set forth in U.S. Pat. No. 3,559,190 issued Jan. 26, 1971 to Donald L. Bitzer, et al.

Various attempts have been made to reduce the costs of AC plasma panel structures. One of the more successful is described in U.S. Pat. No. 4,772,884, entitled "Independent Sustain and Address Plasma Display Panel", by Weber et al The Independent Sustain and Address (ISA) technology has been successfully developed into a practical technology for AC plasma displays. ISA displays have a number of advantages including half the number of required address drivers and a reduction in the address driver power dissipation which allows the practical implementation of advances such as chip-on-glass packaging.

The ISA technology is based on the principle that the addressing and sustain operations have separate electrodes in the panel devoted exclusively to each operation. A pixel is addressed in a multi step process initiated by the application of address pulses to selected address cells. Plasma then spreads out from the address cells to selectively erase targeted pixels.

The prior art ISA structure is shown in FIG. 1. FIG. 2 shows an expanded view of the area in circle 10 in FIG. 1. The expanded view in FIG. 2 shows a basic nine cell group that is the repetitive unit in the ISA geometry. Each of the nine cells is defined in accordance with the types of electrodes that intersect to define a cell. In plasma panels that existed prior to the ISA technology, all cells on the panel were electrically identical and, in fact, were all display pixels. However, in an ISA panel, only four of the nine cells of a cell group are display pixels, i.e., P1, P2, P3, and P4. Those pixel cells are located at the intersections of four sustain electrodes XSa, XSb, YSa, and YSb. Thus, each cell group has four corresponding pixel cell types. As will be understood hereafter, each corresponding cell type (e.g., P1, P2, etc.) in each cell group is subjected to sustain potentials during the operation of a panel, but its response to such potentials is controlled by potentials imposed on address lines that intersect each cell group.

In addition to the four pixel cell types, there are five other cells in a cell group. At the center of the cell group is an address cell A which occurs at the intersection of two address electrodes XA and YA. There are also four coupling cells: C1, C2, C3, and C4 which occur at the intersections of a sustain electrode and an address electrode. The coupling cells are divided into two categories depending upon their position relative to the address cell. The C1 and C4 cells are called vertical coupling cells and the C2 and C3 cells are called horizontal coupling cells. It should be understood, that the terms vertical and horizontal are used merely to designate orthogonal orientations of conductors and cells and for easy reference purposes. No particular global orientation is to be implied therefrom.

In one preferred embodiment, all horizontal electrodes of the ISA panel reside on one substrate of a panel and are referred to as the Y electrodes. All vertical electrodes reside on an opposite substrate and are termed X electrodes. As is well known, an ionizable gas is positioned between the substrates and provides for selected cell illumination. The X address electrodes comprise electrodes 12, 14, 16 and 18 whereas the Y electrodes comprise electrodes 20, 22, 24, and 26. Each X electrode can be selectively addressed by a column address driver circuit 28 and each Y address line can be addressed by a row address driver circuit 30.

X sustain signals are provided by two, phased, sustain generators 32 and 34, with each of the aforementioned sustain generators coupled to a connected pair of parallel sustain lines (e.g. 36, 38). Each pair of sustain lines, e.g. 36, 38, is shorted together by shorting bars at either end, thus forming a sustain electrode pair. Alternating sustain electrode pairs on a given substrate are bussed together by a sustain bus and are connected to one of the two sustain drivers. Row sustain drivers 40 and 42 are similarly connected to interspersed row sustain pairs.

In FIG. 3, waveforms are shown which describe a basic cycle for an ISA plasma panel as described in the aforementioned U.S. Pat. No. 4,772,884. In a preferred mode of operation, two rows of pixel cells are initially turned ON. Then, an erase cycle is performed to selectively turn OFF pixels which the image data indicate should be in the OFF state. The waveforms of FIG. 3 assume that a "write two rows" cycle has already occurred. The selective erase of certain desired ON pixels encompasses two steps. The first step causes a discharge to occur in selected address cells along a selected YA address electrode (see FIG. 2). This results in the migration of wall charges into vertical coupling cells C1 and C4.

Prior to a selective erase cycle occurring, a reset pulse is applied to address lines to reset the wall voltages in vertical coupling cells C1 and C4 and in address cell A. A simultaneous application of sustain voltages to XSa, XSb and YSa, YSb sustain lines with the reset pulses will cause small discharges to occur in the coupling cells which serve to adjust their wall voltages.

Subsequently, erase address pulses 50 and 52 are applied to the XA and YA address lines respectively. This commences Step 1 of the selective erase procedure and its effect is shown in FIG. 4. The erase address waveforms are polarized so that the XA and YA electrodes are the anode and cathode respectively. Since the XA electrode is the anode, the plasma discharge 54, which occurs at address cell A, spreads predominantly towards vertical coupling cells C1 and C4. The voltage across the gaps in each of coupling cells C1 and C4 is such that the spreading plasma deposits significant negative charge into these cells.

Step 2 (see FIG. 4) of the selective erase address performs two degrees of selection. It commences after the trailing edge of erase address pulses 50 and 52 and upon the rise of selection potentials on the sustain electrodes. During Step 2, the selected YS and XA electrodes are the anode and cathode respectively. This polarization enables the plasma 56 generated by the discharge of a coupling cell to spread horizontally away from the cell and into neighboring pixel cells. By raising only the Y sustain line associated with a selected vertical coupling cell, the unselected vertical coupling cell, defined by the non-raised Y sustain line, will not discharge. By raising the X sustain line associated with a pixel to be erased, erasure selection of a pixel is accomplished.

Since the ISA technology relies on the discharge of the address cell to accomplish any addressing, there is always a small amount of light emitted from the panel during any addressing. This light takes the form of a short pulse or pulses emitted from the address cells and pixels involved in the address operation. When a panel is addressed at a high frame rate, such as the commonly used 60 Hz rate, this address light appears to the eye as a slight background glow that makes the OFF pixels appear to glow. This has the effect of slightly reducing the contrast ratio of the panel in a dark room, however this slight background glow is usually not detected by an observer in typical office lighting.

While the addressing light is not a problem for operation at high frame rates such as 60 Hz, it can be an annoyance at low frame rates. For instance, if the display is addressed at a frame rate of only 10 Hz, the eye is able to see the scanning of the address operations because it is below the eye's flicker fusion frequency and the addressing appears as an annoying background glow flicker instead of the continuous glow of the 60 Hz case.

Operation of AC plasma displays at frame rates lower than 60 Hz is necessary whenever there is insufficient addressing time to address all of the pixels in the panel at the full frame rate. This is important for displays having a larger number of pixels. Thus, if the time to address a single horizontal address line is 40 us, then a 640×400 pixel display can be addressed in 400×40 us=16 ms, which corresponds to a frame rate of 1/.016=62.4 Hz. However, a 1280 by 1024 pixel display using the same horizontal line address rate can only be completely addressed in 1024×40 us=40.96 ms which corresponds to a frame rate of 24.4 Hz. The 640 by 400 panel will have no observable background glow flicker, but the 1280 by 1024 will have an easily observable background glow flicker because the 24.4 Hz frame rate is well below the flicker fusion frequency of most observers.

AC plasma displays with large number of pixels are emerging as an important technology. The inherent memory feature of the AC plasma technology gives it a significant advantage over other display technologies because the ON pixels do not flicker for any update rate. In addition the memory function keeps the duty cycle of the pixels at one no matter what the size of the panel or the frame rate. This unity duty cycle keeps the display brightness at a high level, independent of panel size.

A major hurdle in using the ISA technology approach for large plasma panels, is the elimination of the background glow flicker for displays updated at low frame rates.

Accordingly, it is an object of this invention to provide a method for preventing observable flicker in a display panel, wherein addressing results in emitted light.

It is another object of this invention to provide an ISA plasma panel with an improved method for preventing observable flicker.

It is yet another object of this invention to provide large ISA plasma panels which, using prior art techniques would exhibit flicker, with a system for preventing observable flicker without significant extension of address times.

SUMMARY OF THE INVENTION

A method and system are described for reducing flicker in a display panel. The method comprises the steps of sequentially addressing rows of pixels in the panel, each addressed row location made active by applied address signals during a row address period. Addressed locations along an active row emit light when addressed. During a row address period, simultaneous addresses are applied to a plurality of additional dummy rows in the panel. The addressing is accomplished with signals that do not change memory display states at locations along the additional dummy rows, but do cause locations along the additional dummy rows to emit light during each row address period.

Figure 7:
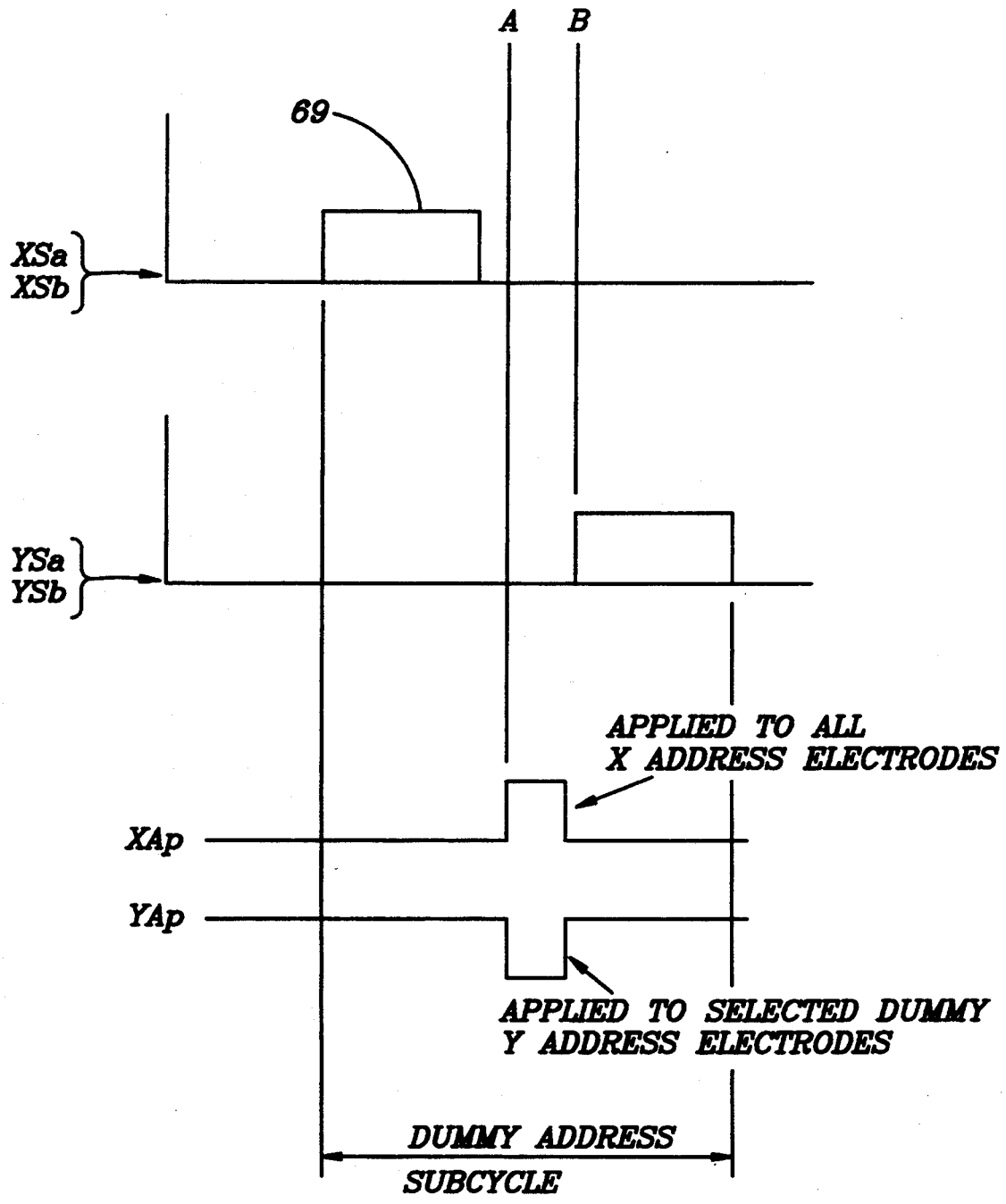
FIG. 7 shows a set of waveforms used to enable a dummy address cycle.
Figure 8A:
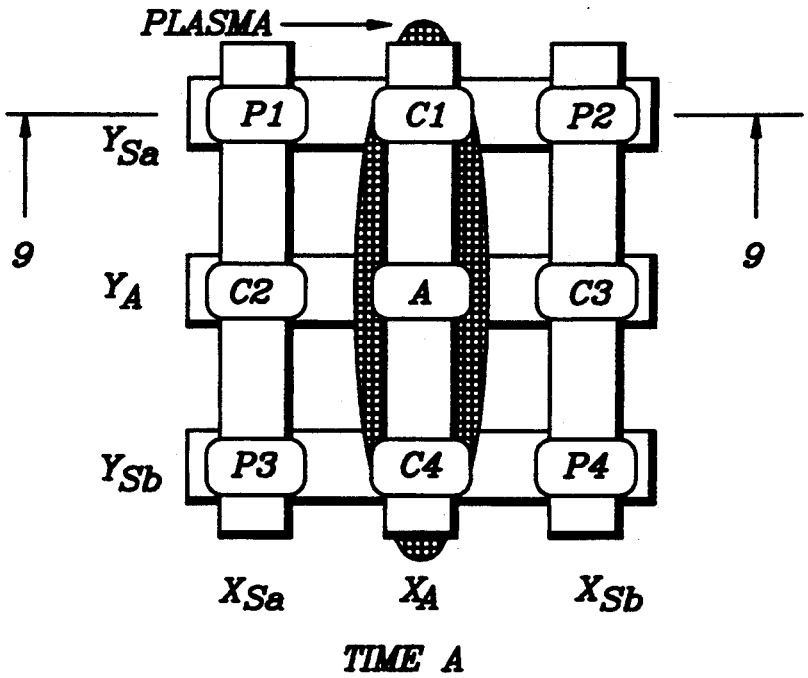
FIG. 8A & B illustrates the condition of a cell group at time A and at time B in the operation of the waveforms of FIG. 7.
Figure 8B:
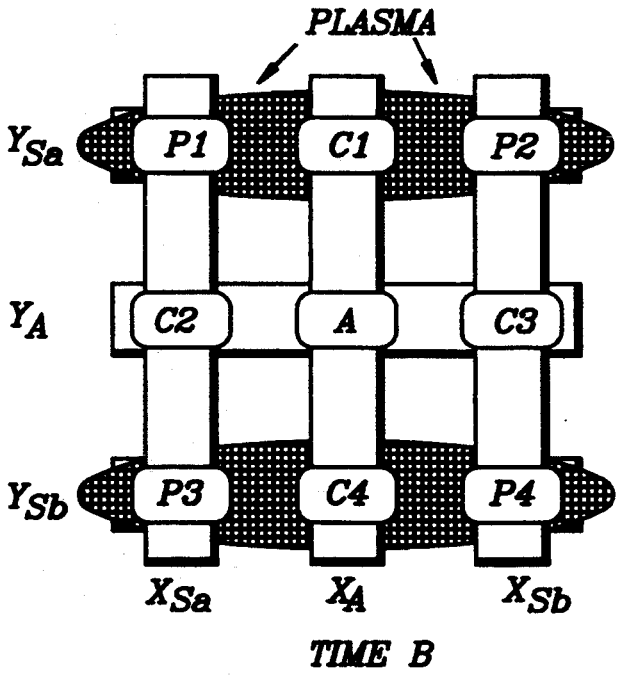

FIGS. **9*a* and 9*b* are sections taken along line 9—9 in FIG. 8 showing wall charge states both before and during discharge at time B in FIG. 7 when pixels p1 and p2** are in the ON state.

FIGS. **10*a* and 10*b* are sections taken along line 9—9 in FIG. 8** showing wall charge states both before discharge and during discharge at time B in FIG. 7, when pixels p1 and p2 are in the OFF state.

Figure 11:
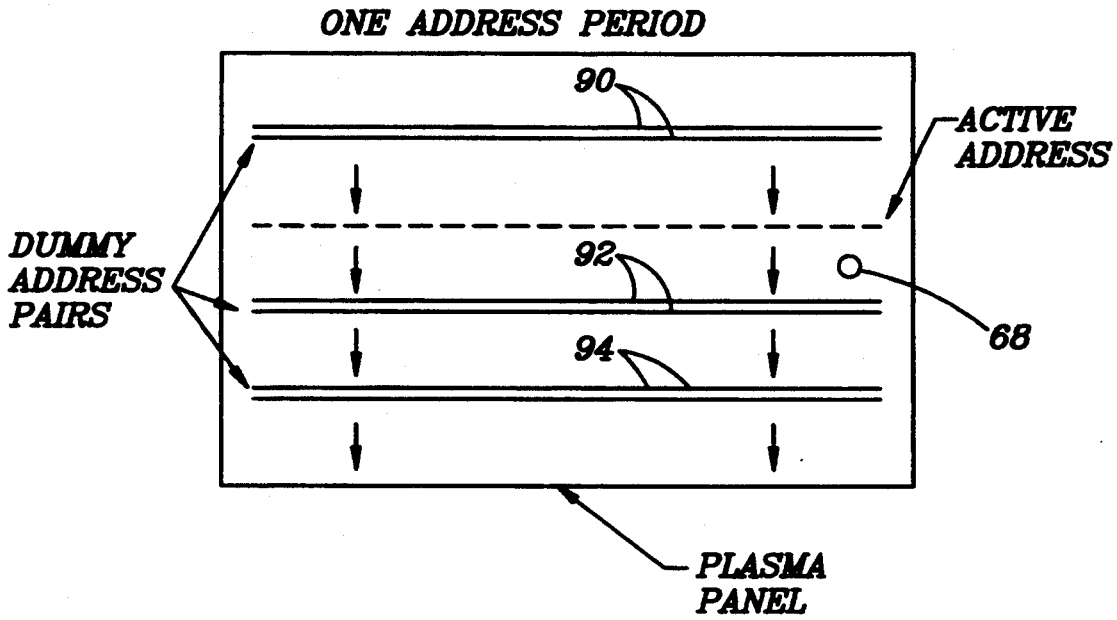

FIG. 11 is a view of the face of a plasma panel that shows how dummy address lines can be paired to increase the amount of emitted light.

DETAILED DESCRIPTION OF THE INVENTION

This invention eliminates background glow flicker detected when an ISA plasma display is operated at a frame rate below the flicker fusion frequency of the observer. This flicker is caused by the slow scan of the addressing light pulses generated during a video (raster) scan addressing operation. The invention relies on the introduction of a special type of addressing that emits light but does not alter the state of the pixels and does not take a significant amount of address time to implement.

While the invention will be described in the context of an AC ISA plasma panel, it is applicable to any display panel whose pixel locations exhibit memory, that operates in a raster scan mode and emits light from an addressed line. The invention employs a modified address cycle, which is divided into two subcycles, a regular address subcycle followed by a dummy address subcycle.

It will be recalled that a preferred mode of operating an ISA panel is to first write two pixel rows, and then selectively erase pixels that are to be in the OFF state. In this invention, all cells are first written to the ON state and then subjected to the modified address cycle. The regular address subcycle employs active address actions which perform the normal address operations and change the states of the pixels. The dummy address subcycle employs dummy address levels which do not change the state of the pixels, but do, when applied, cause the emission of a significant amount of address light when they are applied.

The background glow flicker at low frame rates is eliminated by introducing a sufficient number of dummy address actions during each active address action. Since the observer cannot readily tell the difference between the address light from an active address action and a dummy address action, the addition of the dummy addresses makes the panel appear essentially the same as if the panel was addressed with active address pulses at a higher frame rate.

Figure 5:
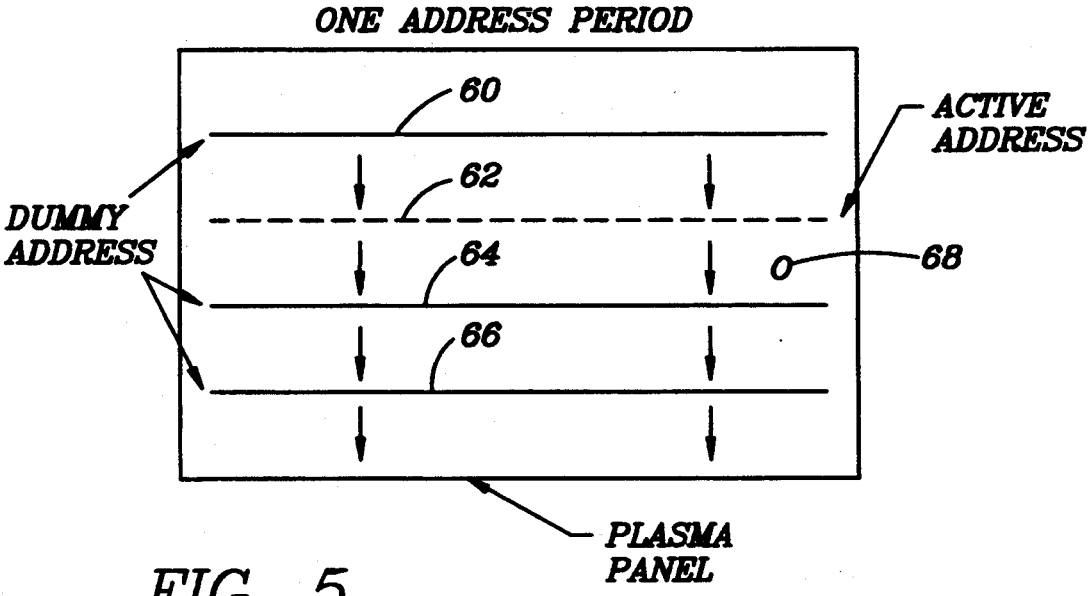
FIG. 5 is a schematic view of the face of a plasma panel display showing both an active addressed line and a plurality of dummy addressed lines.
Figure 4A:
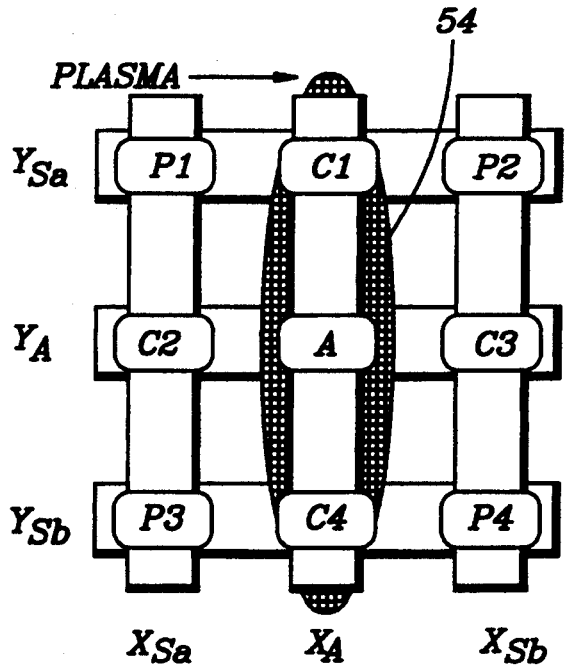
FIG. 4A (PRIOR ART)
FIG. 4A & B illustrates the plasma spreading affects that occur during step 1 and step 2 of a selective erase cycle.
Figure 4B:
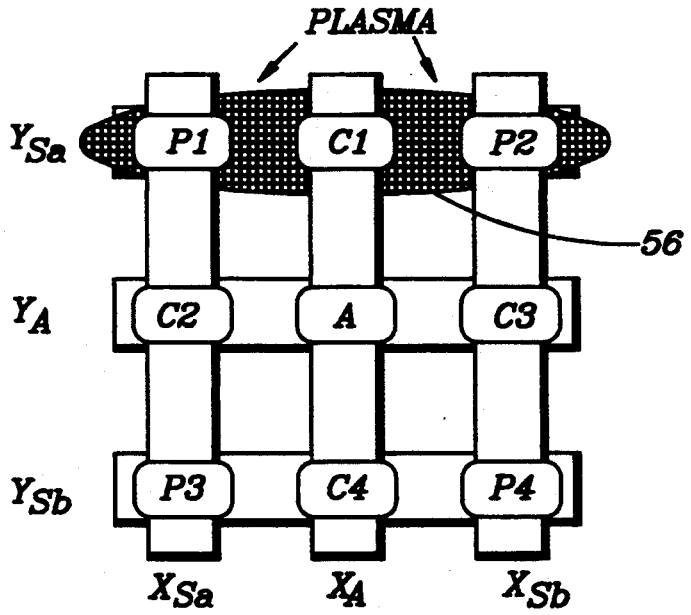
FIG. 4B (PRIOR ART)

FIG. 5 shows a schematic view of a display panel and four horizontal address lines 60, 62, 64 and 66 on the panel. The addressing state of the panel is illustrated during one address period and shows an active address line 62 and three dummy address lines 60, 64 and 66. The addressing operation is sequentially scanned down the panel in the normal raster manner for video displays. The dummy address pulses are applied to address electrodes that are approximately equally spaced from the active address line. This technique assumes that during any given address period, there can be only one active address line. During this same address period there can be almost any number of dummy address lines, however FIG. 5 shows the case of three dummy address lines for exemplary purposes.

Figure 6:
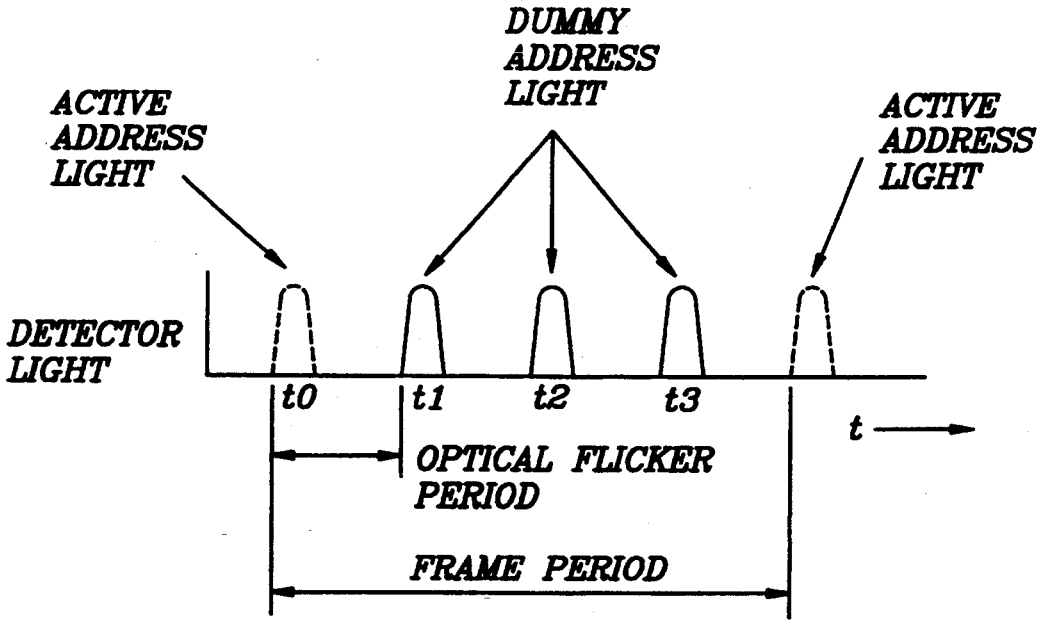
FIG. 6 is a plot of detected light vs. time showing outputs from a light detector in FIG. 5 over a frame period.

Assume that a light detector 68 is placed over one small area of the panel. Light detector 68 does not form part of the invention and is only used to explain the flicker action and the invention's operation. FIG. 6 shows the detection of address light that would occur for the case where all of the pixels under light detector 68 are in the OFF state.

Light detector 68 will register a signal whenever the address scan operation energizes a pixel cell line immediately below its position. A first light pulse 70 is sensed at to from an active address operation applied to the cell line under detector 68. Subsequently, three additional light pulses are sensed at succeeding times t1, t2, t3. These pulses result from dummy address operations that sequentially scan beneath detector 68. After a frame period, the sequence of active address light and dummy address light repeats itself.

Note that the dummy address light pulses look to the detector to be the same amplitude as the active address light and therefore, for the case of three dummy pulses for each active pulse, the optical flicker period appears to be one fourth as long as the frame period. This has the same observed optical effect as quadrupling the frame frequency. Thus, the addition of the dummy address pulses can increase the optical flicker frequency to the point where it is greater than the observer flicker fusion frequency for a display with an active address frame frequency less than the observer flicker fusion frequency.

In brief, a panel's operation in accordance with the invention occurs as follows: an "active" address line (associated with two rows of pixels) is addressed and the two rows of pixels are turned ON. The same active address line is again addressed, and by operation of selected column address lines, the specific cell groups to be subjected to an erase operation are subjected to a step 1 erase action (see the step 1 action illustrated in FIG. 3). Then, by selective application of sustain levels, step 2 erasures of selected pixels occur at the addressed cell groups. Once the erase operation is complete, sustain levels are applied. Up to this point, the ISA panel operation is as described in the '884 patent.

Now, a plurality of spaced dummy row address lines are selected and all pixel cells associated therewith are addressed. This is accomplished by the application of address pulses to all column address lines and to row address lines corresponding to the dummy cell lines. This creates a discharge in the address cells in each cell group along the dummy address lines. In addition, this action deposits wall charges at vertical coupling cells (C1 and C4) in each addressed dummy cell. The address cell discharges create the dummy light pulses shown in FIG. 6.

Next, sustain levels are applied on all YSa sustain lines on the panel causing all ON pixels to discharge. These sustain levels, as will be later understood, do not change the ON or OFF states of pixels along the dummy address lines. At this point, address counters (not shown) for both the active and dummy address row lines are incremented by one and the process is repeated.

While FIG. 6 shows three dummy address actions for each active address action, almost any number of dummy address actions can be chosen. This number is a compromise between having enough dummy address operations to eliminate the flicker and at the same time not having too many to undesirably increase the background glow.

Dummy address pulses must meet the following set of requirements. First they must generate sufficient gas discharge activity in the plasma panel to emit a reasonable amount of light in the selected cells. Second the generation of the required discharge activity from the dummy address pulses must not significantly perturb the wall charge states of any pixels in the panel. This means that all ON cells must remain ON and all OFF cells must remain OFF after the application of the dummy address pulses. This is in contrast to the active address pulses which must change the state of the addressed pixels. The third requirement for dummy address pulses is that their application should not significantly increase the amount of time required for the address period. The reason for this is that any increase in the address period will necessarily decrease the address frame frequency which would offset the flicker reducing advantage of the dummy pulses.

It is preferred that the dummy pulses have the same basic shape as the active address pulses so that the same address driver circuits can be used for both the dummy and the active address pulses. This will result in a lower cost for the electrical circuit design. Clearly other shape dummy pulses are also contemplated as usable within the scope of this invention.

Address pulses in an ISA plasma display are applied to only the address electrodes. The sustain electrodes receive a separate set of pulses which, when applied with a proper phase relationship to the address pulses, results in correct addressing of the display pixels. The active address pulses create discharges in the selected address cells which when combined with the appropriate sustain waveforms result in the proper addressing of pixels. If the same shape address pulses are used for both active and dummy addressing, then it is reasonable to expect that the dummy address pulses will cause a discharge in the address cells very similar to the active addressing discharge. As a result, differentiation between the active and the dummy addressing is accomplished by means of proper selection of the sustain waveforms.

FIG. 7 is a waveform diagram showing a preferred arrangement of the dummy address pulse waveforms. The dummy address subcycle shown in FIG. 7 succeeds the regular address subcycle illustrated in FIG. 3. A sustain pulse at the interface between the subcycles can perform sustain functions for both subcycles and need not be repeated for the dummy subcycle. The XSa, XSb pulse 69 at the beginning of the dummy address subcycle is optional and is only required if previous sustain or address levels have caused initial wall charge states to be of a polarity other than as required for the dummy subcycle.

Figure 1:
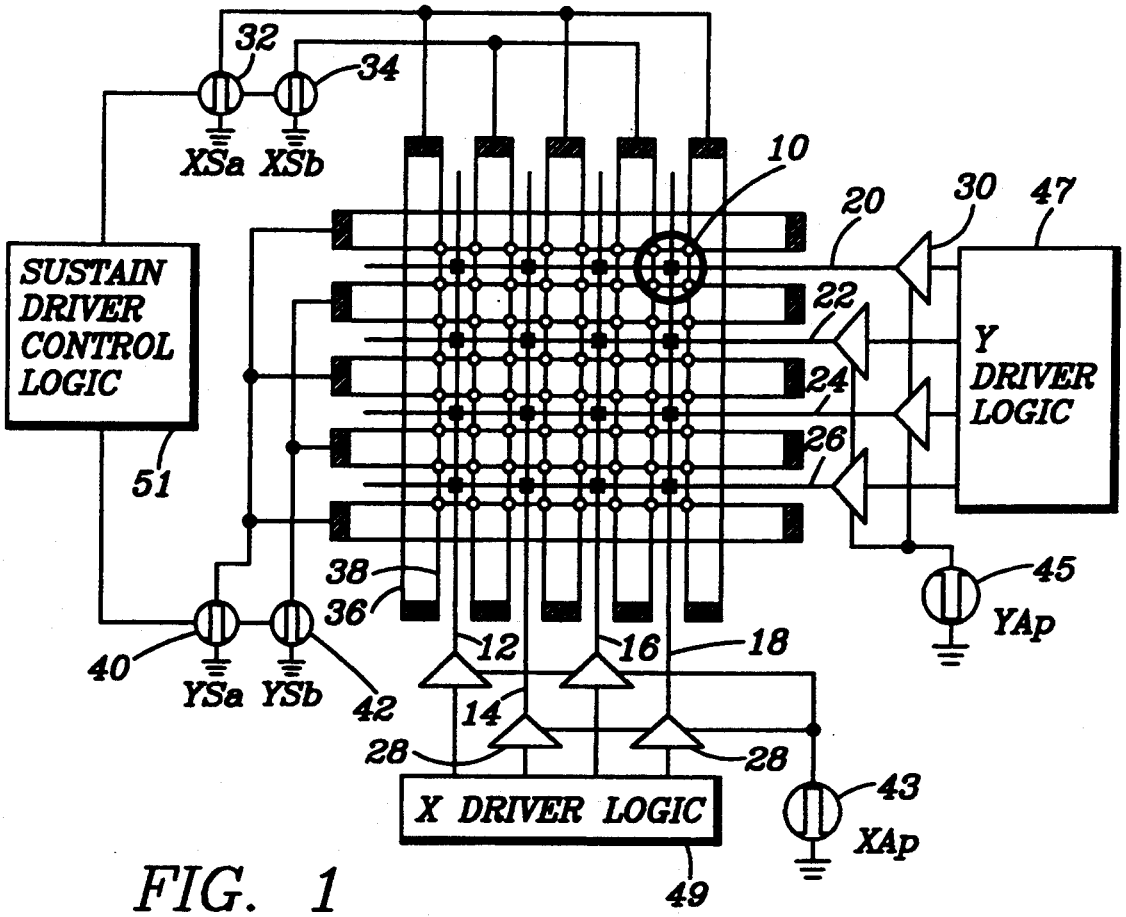
FIG. 1 (PRIOR ART)
FIG. 1 is a circuit diagram of a prior art ISA AC plasma panel.
Figure 2:
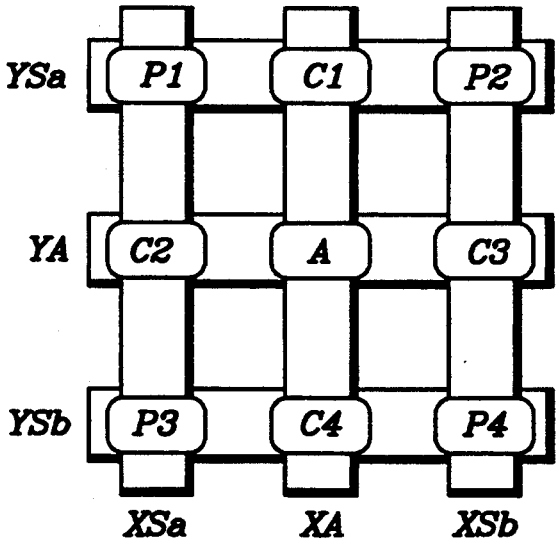
FIG. 2 (PRIOR ART)
FIG. 2 is an expanded view of a cell group from FIG. 1.

XAp and YAp pulsers 43 and 45 (FIG. 1) are initiated at a time A in FIG. 7 and initiate a discharge in all address cells along selected Y address row electrodes. YA address electrodes are selected by Y driver logic 47 (FIG. 1) to apply dummy address pulses during an address period. Unlike the XAp address pulses that are selectively applied during a regular address subcycle, the XAp address pulses for a dummy addressing subcycle are applied to all X address electrodes by X driver logic 49 (i.e. there is no image data-dependent selection).

It is desirable that at time A, all four sustain electrodes are in the same state so that the dummy address discharges influence all pixels in the panel in a uniform manner. FIG. 7 shows that at time A, the X and Y sustain pulses are at a low state. An alternative would be to have all four sustain pulses in the high state.

As mentioned above, the dummy address pulses are applied to address electrodes that are approximately equally spaced from the active address line. This is done in order for the light pulses shown in FIG. 6 to be approximately equally spaced in time. Equal temporal spacing of the light pulses has the effect of reducing or eliminating the low frequency components of the background glow light.

At time B in FIG. 7, sustain control logic 51 causes both YS sustainer pulse generators 40 and 42 to rise to the high state, while XS sustainers 32 and 34 remain low. This sustain action causes a normal sustain discharge activity in ON pixels in the panel. An important point for proper operation of this invention is that the dummy address discharges must not change the state of any pixels in the panel. Since the dummy address pulses in the preferred embodiment are the same as the active address pulses, it is important to examine why the waveforms of FIG. 7 do not cause the states of any pixels to change.

Figure 3:
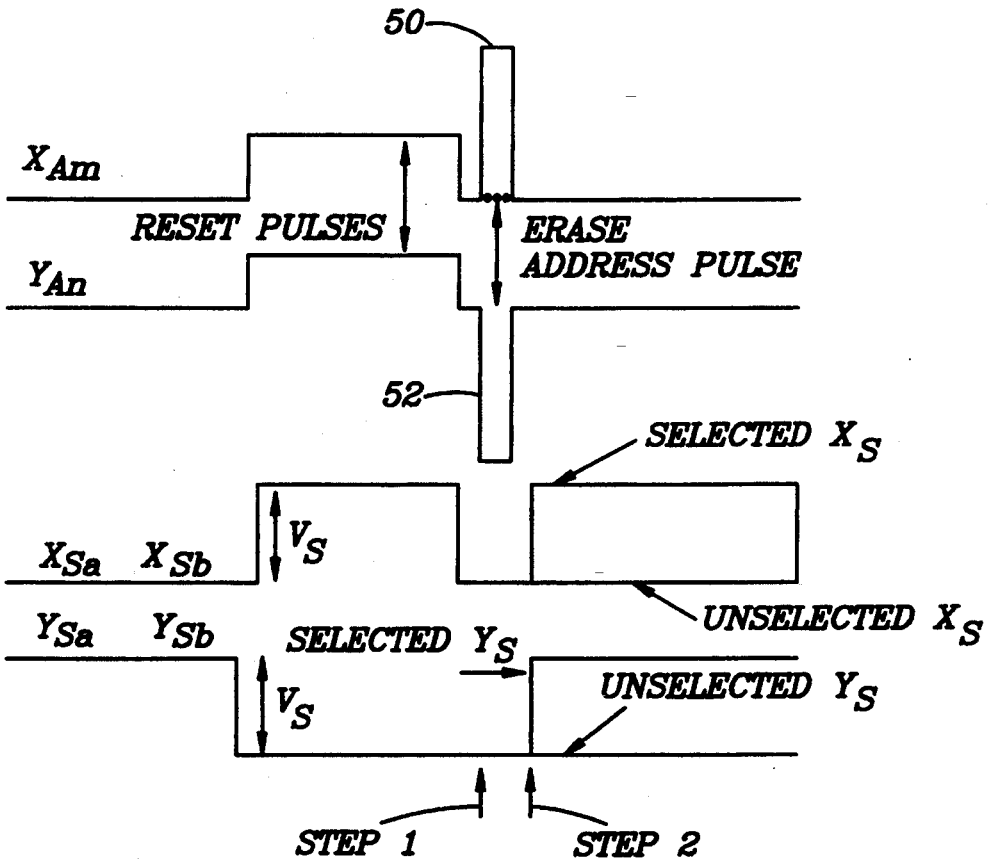
FIG. 3 (PRIOR ART)
FIG. 3 shows a set of waveforms used to address and erase selected pixels in the AC plasma panel of FIG. 1.

With reference to the addressing technique used in ISA displays (as described with respect to FIG. 3), the discharge initiated by the pulses at time A in FIG. 7 is very similar to step 1 of ISA addressing and likewise the discharge at time B is similar to ISA addressing at step 2 in FIG. 3. ISA addressing relies on the plasma generated by the step 1 discharge in the address cell to deposit charge in the vertical coupling cells adjacent to the addressed cell. In step 2, the plasma generated by a discharge in a vertical coupling cell is used to deposit charge on an adjacent, selected pixel to change the state of the pixel. Because of the similarity of the active and the dummy address pulses, the charge deposition properties of the active addressing action also occur during dummy addressing. This means that during dummy addressing (see FIG. 8), charge is deposited on the vertical coupling cells C1 and C4 adjacent to selected Y address electrodes during the time A discharge. In addition, since both YSa and YSb sustain signals rise at time B, both vertical coupling cells (C1, C4) adjacent to the selected address cells will discharge with a plasma that will deposit charge on the neighboring pixels.

Figure 9A:
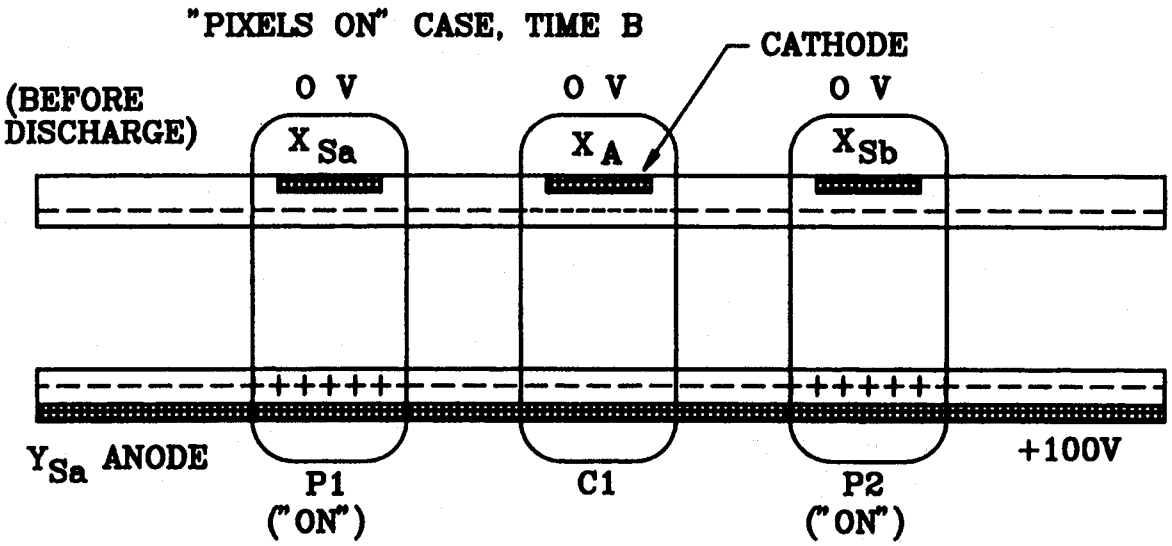

Two dummy addressing cases must be examined, one for pixels in the ON state and the other for pixels in the OFF state. FIGS. **9*a* and 9*b* show a cross section, taken along line 9—9 in FIG. 8, of vertical coupling cell C1 and adjacent pixels P1 and P2 during time B for the case when both pixels P1 and P2 are ON. FIG. 9*a* illustrates the cell states just before discharge at time B, whereas FIG. 9*b*** shows the cell states during discharge (all while the sustain pulse is applied).

Any pixels that are in the ON state at time B (see waveforms of FIG. 7) will have a normal sustain discharge due to the applied YS sustain pulses. This normal sustain discharge activity is of such intensity that it will continue until the voltage across the gas in discharging pixels P1 and P2 is substantially reduced to zero. Any charge deposited by the plasma generated from a vertical coupling cell during the application of a YS sustain pulse after time B will not significantly influence the sustain discharges because the very strong sustain discharge at the pixel cells would occur anyway. Thus the state of the on pixels remains unchanged by the dummy address pulses shown in FIG. 7.

Figure 9B:
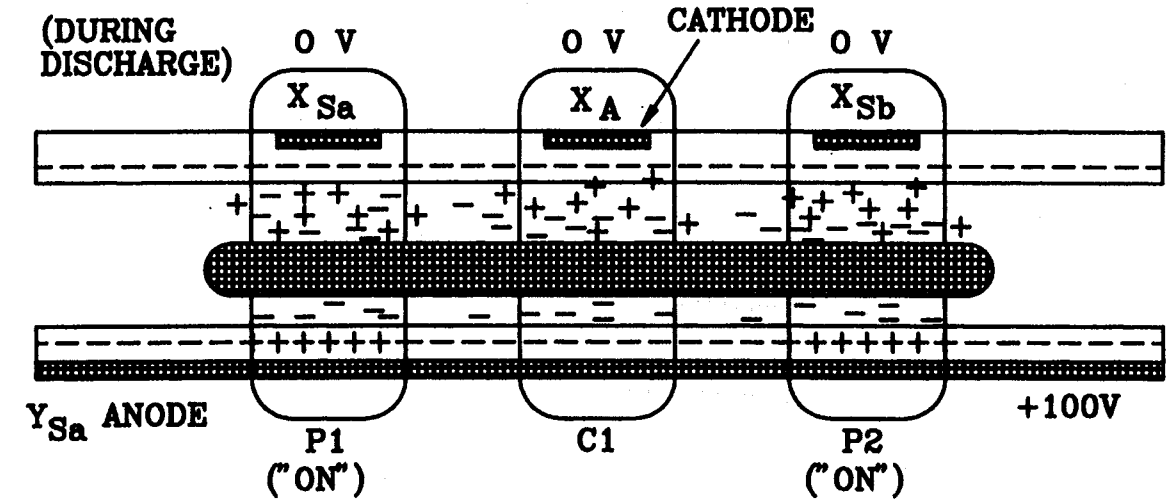
Figure 10A:
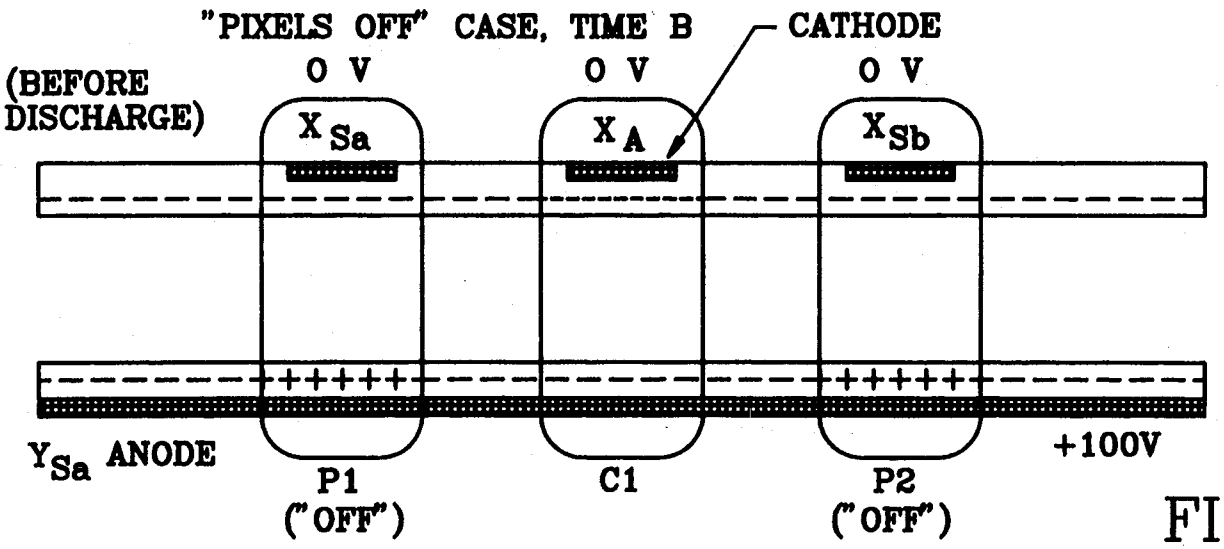
Figure 10B:
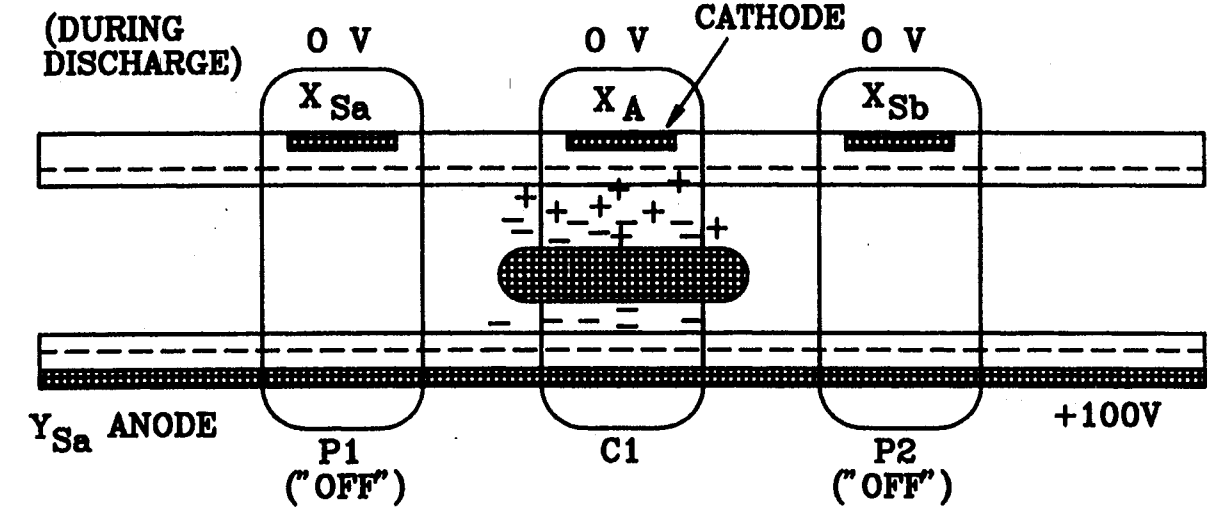

FIGS. **10*a* and 10*b* are similar to FIGS. 9*a* and 9*b* except that the pixels are initially OFF. The application of the YS sustain pulses at time B does not cause discharges in pixels P1 and P2 since the pixels are OFF and so there is no positive wall charge on the YSa anodes intersecting the pixels. When the discharge from coupling cell C1** creates a plasma, it does not spread significant charge to neighboring pixels P1 and P2 because of the lack of positive charge on the YS anode at the pixel sites. Thus the pixels remain in the OFF state.

Note that at time B in FIG. 7, both the XSa and the XSb sustain pulses remain at the low level. That is critical because if one or both were to rise, then the ON pixels associated with a rising X sustain pulse would errantly be erased by the discharge activity associated with the dummy address pulses. The low level XS pulses at time B is a major factor that differentiates the dummy address subcycle operation from an active address subcycle operation.

The active address subcycle normally erases ON pixels during step 2. Such action occurs just after removal of the address pulse and the rise to a high level of both the X and the Y sustain waveforms that intersect the pixel type to be erased. If an XS waveform were to rise to a high level at time B in FIG. 7, during a dummy address subcycle, then both an X and Y sustain would be high which is the condition for erasure.

While the dummy address waveforms shown in FIG. 7 use the sequence of first an XS sustain pulse followed by the address pulses and then finally the YS sustain pulses, another sequence has been found operate. This sequence simply reverses the order of the XS and YS sustain pulses. The alternate sequence is to first apply the YS sustain pulses, then the address pulses and finally the XS sustain pulses. Both sequences work satisfactorily as long as XS and YS sustainers are not high during time B, as discussed above.

It is desirable that the active address operation generate the same amount of light as the dummy address operations. However, it is frequently the case that active address operation light is greater than the dummy address operation light. This is because the active address operation usually requires some sustain discharges from the pixels adjacent the address cells and these sustain discharges appear to the eye as address light. On the other hand, the dummy address light comes only from the address cells and does not cause sustain discharges.

One method for increasing dummy address light is to increase the amplitude of the dummy XAp or YAp pulses so that the dummy discharge activity is greater. This has the disadvantage of requiring an extra, costly circuit to generate dummy pulses with a different amplitude than the active pulses. In addition, if the dummy pulses have too great an amplitude, some errant addressing may occur.

There are several preferred ways to increase dummy address light while at the same time keeping the amplitude of the active and the dummy address pulses the same. The first technique, for any single addressed row, is to increase the number of dummy address subcycles to be as great as possible for each active address subcycle. While in principle any number of dummy subcycles could be applied for each active address subcycle, there is a practical limit imposed by the amount of time in the address cycle that can be devoted to the dummy address subcycle. A practical limit dictated by a need not to extend, significantly, an address period, is probably one dummy address subcycle for each active address subcycle. It is to be understood that this limitation applies to address operations on any single row. Clearly, the dummy address operation can be applied to as many rows, simultaneously, as is allowed by panel operating parameters.

The second preferred technique for increasing the amount of dummy address light (while preserving identical active and dummy pulses) is to increase the number of selected dummy address Y lines for each active address Y line selected. FIG. 5 shows that during one address period, a single active Y (row) address line is selected. For the case presented in FIG. 5, three additional dummy address operations were chosen in order to increase the observed optical flicker frequency to a value above the flicker fusion frequency. FIG. 11 shows a similar configuration, with the same observed optical flicker frequency, but with increased dummy address light. Note that for each dummy address line in FIG. 5, there are a pair of lines 92, 94 and 96 in FIG. 11. Each dummy address pair represents Y (row) selection of two adjacent YA address electrodes. Dummy addressing a pair of address electrodes will generate twice as much dummy light as dummy addressing a single electrode. This double dummy light can be used to achieve balance with the active address light in order to achieve the desired equality of active and dummy light.

The pairs of dummy address operations are chosen to be on two adjacent YA address electrodes because as the scan of these two lines passes under light detector 68, the two closely spaced light pulses appear at such a high frequency that the human observer will not be able to distinguish the two pulses from a single pulse with twice the light. If the light from a single active address operation in one address period is twice that from a single dummy address operation in the same address period, then the paired dummy configuration will achieve the desired balance of active and dummy light.

If, alternatively, the pair of dummy address operations were spaced far from each other with the extreme case of all six dummy address lines of FIG. 11 being equally spaced, the background light is more likely to flicker. This flicker could occur because although the frequency of the dummy pulses would probably be well above the flicker fusion frequency, the brighter active address pulses will likely generate frequency components that will be below the flicker, fusion frequency. Placing the paired dummy address operations on adjacent YA address lines, as shown in FIG. 11, for the case of an active to dummy light ratio of two, minimizes the low frequency light components observed as background light flicker.

While the example shown in FIG. 11 and discussed above presents pairs of dummy address operations, the background glow flicker reducing properties of this invention can also be achieved for groups of dummy address operations greater than two. The important principles are that the groups of dummy operations occur on adjacent YA address lines and that the total integrated light from the dummy address group be nearly equal to the light from the active address operation in a single address period. In practice the number of selected dummy address lines in a group is chosen in order to achieve the optimum balance of dummy light and active light to attain the desired reduction in background light flicker.

This disclosure presents techniques for eliminating background glow flicker for ISA plasma displays. However the introduction of dummy address operations is equally applicable to raster-scanned displays (other than ISA plasma displays) that exhibit cell memory and emit light from addressed lines as scanning occurs from one extremity of the display to another (e.g., thin film liquid crystal displays). For instance, AC plasma displays with conventional non-ISA addressing that use a write-before-erase technique, generate active address light that will cause an undesirable background glow flicker when addressed at a low frame rate. The dummy addressing principles presented herein will apply to this type of display.

While the invention has been particularly shown and described with respect to a preferred embodiment thereof, it will be understood by those skilled in the art that changes in form and details may be made therein without departing from the scope and spirit of the invention.

What is claimed is:

1. A method for reducing flicker in an AC plasma memory display that includes a plurality of pixels arranged in intersecting rows and columns, comprising the steps of:

(a) sequentially addressing rows of pixels in the display so as to alter pixel memory display states, each addressed row location made active by address signals applied to an address line during a first interval in a row address period, addressed locations along an active row emitting light when addressed; and (b) during a second interval that is non-overlapping in time with said first interval in said row address period, addressing at least a selected additional row in said display with signals that do not change memory display states at locations along said additional row but do cause locations along said additional row to emit light and for each sequentially addressed row of pixels in step a during subsequent row address periods, addressing at least a succeeding additional row displaced by at least one row from a previously selected additional row as in this step b.

2. The method as recited in claim 1 wherein a plurality of additional rows are subjected to said addressing action of step (b) and wherein said additional rows are substantially equally spaced from each other and from a said active row.

3. The method as recited in claim 2 wherein identical signals are employed to address both active rows and additional rows.

4. The method as recited in claim 2 wherein said signals employed in step b exhibit increased amplitudes from address signals employed in step a, to thereby increase emitted light from said additional rows.

5. The method as recited in claim 2 wherein said signals employed in step b appear in an address subcycle followed by a dummy address subcycle, there being a plurality of dummy address subcycles for each address subcycle to increase emitted light from said additional rows.

6. The method as recited in claim 2 wherein said display is operated in a raster scan mode.

7. The method as recited in claim 6 comprising the further step of:

applying a sustaining signal to said active row and said additional rows to continue light emissions from said rows.

8. The method as recited in claim 6 wherein said signals employed in step b exhibit increased amplitudes from address signals employed in step a, to thereby increase emitted light from said additional rows.

9. The method as recited in claim 6 wherein said signals employed in step b appear in an address subcycle followed by a dummy address subcycle, there being a plurality of dummy address subcycles for each address subcycle to increase emitted light from said additional rows.

10. The method as recited in claim 2 wherein said additional rows are organized into groups of additional rows, each said group substantially equally spaced from other groups and from a said active row, each said group providing a combined light emission that is approximately equivalent to the light emission from said active row.

11. The method as recited in claim 10 wherein identical signals are employed to address both active rows and additional rows.

12. The method as recited in claim 10 wherein each row in a said group of rows is immediately contiguous.

13. The method as recited in claim 12, wherein as each row of pixels is sequentially made active, positions of said additional rows are sequenced on said panel in lock step, as the position of the active row is sequenced.

14. The method as recited in claim 13 wherein said panel is operated in a raster scan mode and all rows of pixels are made active on said panel once a frame period, all said additional groups of rows similarly addressed and positionally sequenced with said active rows.

15. The method as recited in claim 14 comprising the further step of:

applying a sustaining signal to said active row and said additional groups of rows to continue light emissions from said rows.

16. A method for reducing flicker in an ISA AC plasma display panel, wherein said panel comprises a plurality of rows of cell groups aligned along a first dimension, each said cell group including an address cell, two associated coupling cells aligned along a second dimension orthogonal to said first dimension and four pixel cells, first and second dimension address lines intersecting each said address cell, first and second dimension sets of and sustain lines positioned on either side of each said address line and intersecting adjacent series of pixel cells and coupling cells in each cell group, intersections between sustain lines defining said pixel cells, said method comprising:

a. during a first interval in a row address period, energizing first and second dimension address lines to cause discharges of address cells and a deposition of wall charges in associated second dimension coupling cells in selected cell groups along a row;

b. energizing said sustain lines to selectively erase pixel cells in each said selected cell group by a transfer of charge from said coupling cells so as to alter pixel cell display states, said energizing steps a and b causing light to be emitted from said row of cell groups;

c. energizing during a second interval that is non-overlapping in time with said first interval in said row address period, first and second dimension address lines which intersect cell groups along a plurality of additional rows of cell groups to cause discharges and emissions of light at address cells in said cell groups, and wall charge depositions in associated second of said first and second dimension sets of coupling cells therein; and d. applying sustain potentials to only one dimension sustain lines in said panel, whereby said wall charges deposited at coupling cells at step c are not enabled to affect the wall charge states of any pixel cells in said additional rows of cell groups and, e. repeating steps a and b for sequential rows of cell groups in succeeding row address periods and for each repetition, repeating steps c and d for a plurality of additional rows of cell groups that are displaced by one row of cell groups from a previous row of cell groups that were subjected to steps c and d.

17. The method as recited in claim 16 wherein steps a and b are sequenced in a panel in a raster scan manner.

18. The method as recited in claim 16 wherein said additional rows of cell groups are equally spaced from each other and from an addressed row of cell groups.

19. The method as recited in claim 16 wherein said additional rows of cell groups are organized into groups of additional rows, each said group substantially equally spaced from other groups and from a said addressed row of cell groups, each said group providing a combined light emission that is approximately equivalent to the light emission from said addressed row of said cell groups.

20. The method as recited in claim 16 wherein said energizing, as recited in steps a and c, applies identical signals to address lines.

21. The method as recited in claim 16 wherein the step of energizing recited in step c applies signals which exhibit increased amplitudes from signals applied by the step of energizing recited in step a, to thereby increase emitted light from said additional rows.

22. The method as recited in claim 16 wherein the step of energizing recited in step c applies signals in an address subcycle which is followed by a dummy address subcycle, there being a plurality of dummy address subcycles for each address subcycle to increase emitted light from said additional rows.

23. A system for reducing flicker in an AC plasma memory display that includes a plurality of pixels arranged in intersecting rows and columns, the system comprising:

means for sequentially addressing rows of pixels located in the display so as to alter pixel memory display states, each addressed row location made active by address signals applied to an address line during a first interval in a row address period, addressed locations along an active row emitting light when addressed; and means for dummy addressing at least a selected additional row in said display during a second interval that is non-overlapping in time with said first interval in said row address period, said dummy addressing means employing signals that do not change memory display states at locations along said additional row, but do cause locations along said additional row to emit light during a said row address period and for each sequentially addressed row of pixels whose memory states are to be altered during subsequent row address periods, dummy addressing at least a succeeding additional row displaced by at least one row from a previously dummy addressed row with signals that do not change memory display states.

24. The system as recited in claim 23 wherein plurality of rows are subjected to said dummy addressing and wherein said additional rows are substantially equally spaced from each other and from a said active row.

25. The system as recited in claim 24 wherein said sequential addressing means operates said display in a raster scan mode and renders all rows of pixels active on said panel once a frame period, said dummy addressing means addressing said additional rows in lock step with said active rows.

26. The system as recited in claim 25 further comprising:

means for applying a sustaining signal to said active row and said additional rows to continue light emissions from said rows.

27. The system as recited in claim 24 wherein said additional rows are organized into groups of additional rows, each said group substantially equally spaced from other groups and from a said active row, each said group providing a combined light emission that is approximately equivalent to the light emission from said active row.

28. The method as recited in claim 27 wherein each row in a said group of rows is immediately contiguous.

29. The system as recited in claim 23 wherein signals employed by said dummy addressing means exhibit increased amplitudes from address signals employed by said sequential addressing means to thereby increase emitted light from said selected additional row.

30. The system as recited in claim 23 wherein signals employed by said dummy addressing means appear in an address subcycle followed by a dummy address subcycle, there being a plurality of dummy address subcycles for each address subcycle to increase emitted light from said selected additional row.

31. A system for reducing flicker in an ISA AC plasma display panel, wherein said panel comprises a plurality of rows of cell groups aligned along a first dimension, each said cell group including an address cell, two associated coupling cells aligned along a second dimension orthogonal to said first dimension and four pixel cells, first and second dimension address lines intersecting each said address cell, first and second dimension sets of and sustain lines positioned on either side of each said address line and intersecting adjacent series of pixel cells and coupling cells in each cell group, intersections between sustain lines defining said pixel cells, said system further comprising:

address means for energizing first and second dimension address lines during a first interval in a row address period, to cause discharges of address cells and a deposition of wall charges in associated second dimension coupling cells in selected cell groups along a row; sustain means for energizing said sustain lines to selectively erase pixel cells in each said selected cell group by a transfer of charge from said coupling cells so as to alter pixel cell display states, said energizing causing light to be emitted from said row of cell groups;

dummy address means for energizing during a second interval that is non-overlapping in time with said first interval in said row address period, first and second dimension address lines which intersect cell groups along a plurality of additional rows of cell groups to cause discharges and emissions of light at address cells in said cell groups, and wall charge depositions in associated second dimension coupling cells therein; and dummy sustain means for applying sustain potentials to only one of said first and second dimension sets of sustain lines in said panel, whereby said wall charges deposited at coupling cells by operation of said dummy address means are not enabled to affect the wall charge states of any pixel cells in said additional rows of cell groups; and means responsive to operation of said address means with respect to selected cell groups in a succeeding row address period, to cause said dummy address means and dummy sustain means to operate upon a plurality of additional rows of cell groups that are sequentially displaced by one row of cell groups from a previously operated upon plurality of additional rows of cell groups.

32. The system as recited in claim 31 wherein said additional rows of cell groups are equally spaced from each other and from an addressed row of cell groups.

33. The method as recited in claim 32 wherein said additional rows of cell groups are organized into groups of additional rows, each said group substantially equally spaced from other groups and from a said addressed row of cell groups, each said group providing a combined light emission that is approximately equivalent to the light emission from said addressed row of said cell groups.

* * * * *

UNITED STATES PATENT AND TRADEMARK OFFICE

CERTIFICATE OF CORRECTION

PATENT NO. : 5,430,458
DATED : July 4, 1995
INVENTOR(S) : Larry F. Weber

It is certified that error appears in the above-indentified patent and that said Letters Patent is hereby corrected as shown below:

Claim 12 (col. 12), lines 62, 63, cancel "of said first and second dimension sets of" and insert -- dimension --.

Claim 12 (col. 12), line 64, cancel "dimension" and insert -- of said first and second dimension sets of --.

Signed and Sealed this

Ninth Day of January, 1996

Bruce Lehman

*Attest:*

BRUCE LEHMAN

*Attesting Officer*

*Commissioner of Patents and Trademarks*